United States Patent [19]

Ferguson

[11] Patent Number: 4,710,141

[45] Date of Patent: Dec. 1, 1987

[54] MARINE PROPULSION DEVICE POWER STEERING SYSTEM

[75] Inventor: Arthur R. Ferguson, Northbrook, Ill.

[73] Assignee: Outboard Marine Corporation, Waukegan, Ill.

[21] Appl. No.: 614,821

[22] Filed: May 29, 1984

[51] Int. Cl.[4] ..... B63H 21/26

[52] U.S. Cl. ..... 440/61; 114/144 R; 137/625.69; 251/294

[58] Field of Search ..... 440/53, 61, 900; 114/144 R; 91/358, 368, 383; 137/625.69; 251/294; 74/876; 244/78, 227

[56] References Cited

U.S. PATENT DOCUMENTS

| | | | |
|---|---|---|---|
| Re. 27,932 | 2/1974 | Mettetal, Jr. . | |
| 2,479,063 | 8/1949 | Forsythe | 114/150 |
| 2,618,235 | 11/1952 | Clark | 115/35 |
| 2,855,755 | 10/1958 | Auger . | |
| 2,929,362 | 3/1960 | Hayner | 121/41 |
| 2,939,417 | 6/1960 | Hammock . | |
| 3,358,564 | 12/1967 | Peterson | 91/375 |
| 3,373,642 | 3/1968 | Simpson | 83/76 |
| 3,570,442 | 3/1971 | Shimanckas . | |
| 3,631,833 | 1/1972 | Shimanckas . | |
| 3,772,966 | 11/1973 | Mills . | |
| 3,986,578 | 10/1976 | Chanal | 180/158 |
| 4,041,889 | 8/1977 | Blanchard | 114/144 R |
| 4,227,481 | 10/1980 | Cox et al. | 440/61 |
| 4,295,833 | 10/1981 | Borst | 440/61 |
| 4,375,920 | 2/1983 | Hall et al. | 440/61 |
| 4,399,734 | 8/1983 | Kobelt | 91/1 |
| 4,595,370 | 6/1986 | Small | 440/61 |

FOREIGN PATENT DOCUMENTS

| | | |
|---|---|---|
| 526093 | 11/1981 | Australia . |
| 57-227561 | 7/1984 | Japan . |
| 1394929 | 5/1975 | United Kingdom . |

OTHER PUBLICATIONS

Three (3) pages from a 1981 publication of W. H. Denouden—(U.S.A.) Inc.

*Primary Examiner*—Jeffrey V. Nase
*Assistant Examiner*—Thomas J. Brahan
*Attorney, Agent, or Firm*—Michael, Best & Friedrich

[57] ABSTRACT

The marine propulsion device includes a propulsion unit mounted for tilting movement about a generally horizontal tilt axis and for pivotal steering movement about a vertical steering axis, and a power steering system adapted to operably connect an actuator to the propulsion for increasing the steering force applied to the propulsion unit by the actuator. The power steering system is wholly supported on the propulsion unit and includes a hydraulic cylinder-piston assembly having an axis extending in fixed parallel rotation to the tilt axis and including a cylinder, a piston mounted in the cylinder, and an extendable and retractable piston rod connected to the piston, and a control valve connected to a source of pressurized hydraulic fluid for selectively controlling the flow of hydraulic fluid to and from the opposite sides of the piston to extend and retract the piston rod. The control valve includes a valve member and valve housing rotatably and axially movable relative to each other. The valve member is connected to the actuator and the valve housing is connected to the piston rod for common movement and is connected to the propulsion unit to affect steering movement thereof in response to movement of the actuator.

40 Claims, 8 Drawing Figures

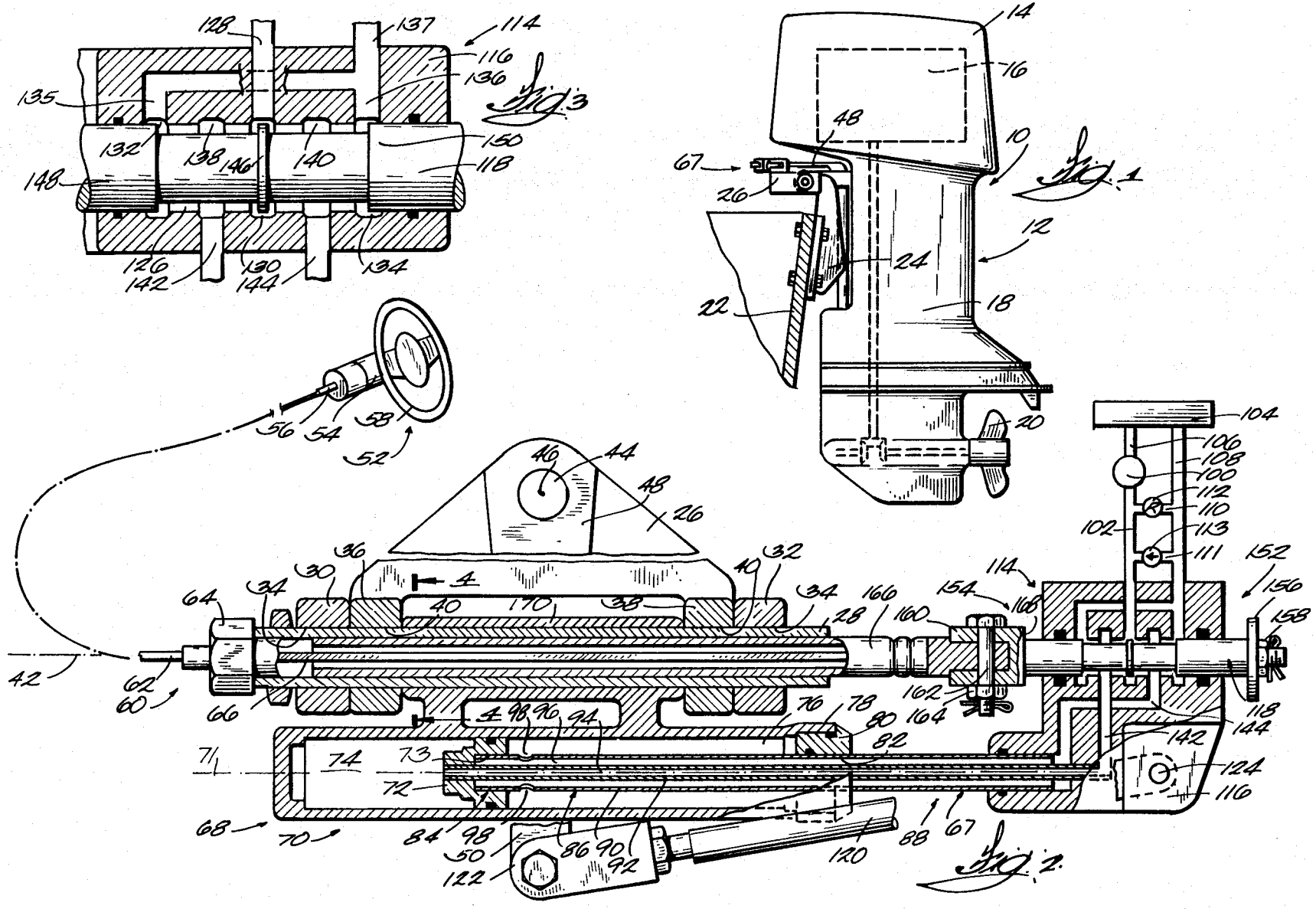

MARINE PROPULSION DEVICE POWER STEERING SYSTEM

BACKGROUND OF THE INVENTION

This invention relates to marine propulsion devices, such as outboard motors and stern drive units, including a power steering system.

Attention is directed to the following U.S. patents which disclose prior art power steering systems for marine propulsion devices:

| Patentee | U.S. Pat. No. | Issue Date |
|---|---|---|
| Hammock | 2,939,417 | June 7, 1960 |
| Shimanckas | 3,631,833 | January 4, 1972 |
| Borst | 3,774,568 | January 27, 1973 |
| Cox et al. | 4,227,481 | October 14, 1980 |
| Borst | 4,295,833 | October 20, 1981 |
| Hall et al. | 4,373,920 | February 15, 1983 |
| Borst | 4,419,084 | December 6, 1983 |

Attention is also directed to the following pending U.S. applications: Ferguson application Ser. No. 293,324, filed Aug. 17, 1981; Hall et al application Ser. No. 485,028, filed Apr. 14, 1983; Hall application Ser. No. 484,900, filed Apr. 14, 1983; and Hall application Ser. No. 558,041, filed Dec. 5, 1983.

The power assist mechanism disclosed in the Shimanckas U.S. Pat. No. 3,631,833 includes a piston rod connected to a boat transom and, therefore, is not wholly supported on mounting means mounted on a boat and connected to the propulsion unit to afford steering movement. The steering mechanism disclosed in the Hall et al U.S. Pat. No. 4,373,920 does not function as a power assist for increasing the steering force applied to the propulsion unit by an actuator. The power assist mechanism disclosed in the Borst U.S. Pat. No. 4,419,084 includes a gear arrangement which is driven by an electric motor and is controlled by a push-pull cable.

SUMMARY OF THE INVENTION

The invention provides a marine propulsion device including a propulsion unit, mounting means adapted to be mounted on a boat and connected to the propulsion for affording tilting movement of the propulsion unit about a generally horizontal tilt axis and pivotal steering movement in opposite directions about a steering axis transverse to the tilt axis, a hydraulic cylinder-piston assembly having an axis extending in fixed, parallel relation to the tilt axis and including a cylinder and a piston dividing the cylinder into opposite sides, with either the cylinder or the piston being fixed against movement axially of the hydraulic cylinder-assembly axis and the other being axially movable, and a control valve assembly including a valve member and a valve housing movable relative to each other. The valve housing is adapted to be connected to a source of pressurized hydraulic fluid and is hydraulically connected to the opposite sides of the cylinder and the valve member and valve housing are movable relative to each other to control flow of hydraulic fluid from the source to the cylinder. One of the valve housing and the valve member is connected with the other of the cylinder and the piston for common movement, means are connected the other of the valve housing and the valve member for displacing of the other of valve member and the valve housing relative to the one of the valve housing and the valve member in response to operator activity, and means connect the propulsion unit to the other one of the cylinder and the piston for effecting steering movement of the propulsion unit in response to movement of the other of the cylinder and the piston incident to the application pressurized hydraulic fluid to the cylinder by the control valve assembly.

The invention also provides a marine propulsion device including a propulsion unit, mounting means adapted to be connected on a boat and connected to the propulsion unit for affording tilting movement of the propulsion unit about a generally horizontal tilt axis and pivotal movement in opposite directions about a steering axis transverse to the tilt axis, a hydraulic cylinder-piston assembly including a cylinder and a piston located in the cylinder, with one of the cylinder and the piston being fixed against movement axially of the hydraulic cylinder-piston assembly axis and the other being relatively axially movable, and a control valve assembly including a valve member and a valve housing rotatably and axially movable relative to each other. The valve member is axially movable on an axis generally coinciding with the tilt axis, the valve housing is adapted to be connected to a source of pressurized hydraulic fluid and is hydraulically connected to the opposite sides of the cylinder, and the valve member and valve housing are movable relative to each other to control flow of hydraulic fluid from the source to the cylinder. One of the valve housing and the valve member is connected with the other of the cylinder and the piston for common movement, means are connected to the other the valve housing and the valve member for displacing the other of the valve member and the valve housing relative to the one of the valve housing and the valve member in response to operator activity, and means connect the propulsion unit to the other one of the cylinder and the piston for effecting steering movement of the propulsion unit in response to movement of the other of said cylinder and the piston incident to the application of pressurized hydraulic fluid to the cylinder by the control valve assembly.

The invention also provides a marine propulsion device including a propulsion unit, means adapted to be mounted on a boat and connected to the propulsion unit for affording tilting movement of the propulsion unit about a generally horizontal tilt axis and pivotal steering movement in opposite directions about a steering axis transverse to the tilt axis, a hydraulic cylinder-piston assembly including a cylinder and a piston located in the cylinder, with one of the cylinder and the piston being fixed against movement axially of the hydraulic cylinder-piston assembly axis and being wholly supported on the mounting means and the other of the cylinder and the piston being axially movable relative to one of the cylinder and the piston, and a control valve assembly including a valve member and a valve housing movable relative to each other. The valve housing is adapted to be connected to a source of pressurized hydraulic fluid and is hydraulically connected to the opposite sides of the cylinder, and the valve member and valve housing are movable relative to each other to control flow of hydraulic fluid from the source to the cylinder. One of the valve housing and the valve member is connected with the other of the cylinder and the piston for common movement, means are connected to the other the valve housing and the valve member for displacing the other of the valve member and the valve housing relative to the one of the valve housing and the valve member in response to operator activity, and the propulsion unit is connected the other one of the cylinder and the piston for effecting steering movement of the propulsion unit in response to movement of the other of the cylinder and the piston incident to the application of pressurized hydraulic fluid to the cylinder by the control valve assembly.

In one embodiment, the valve member and the valve housing are rotatably and axially movable relative to each other and the valve member is axially movable on an axis generally coinciding with the tilt axis.

In one embodiment, the actuator includes a push-pull cable which is connected to the valve member.

The invention also provides a marine propulsion device including a propulsion unit, mounting means adapted to be mounted on a boat and connected to the propulsion unit for affording pivotal steering movement of the propulsion unit in opposite directions about a steering axis and power assist means adapted to operably connect an actuator to the propulsion unit for increasing the steering force applied to the propulsion unit by the actuator. The power assist means is wholly supported on the mounting means and includes a hydraulic cylinder-piston assembly including a cylinder, a piston mounted in the cylinder for reciprocative movement therein and an extendable and retractable piston rod connected to the piston, and control means for selectively extending and retracting the piston rod. The control means includes first and second members rotatably and axially movable relative to each other. One of the members are adapted to be connected to the actuator for axial movement relative to the other in response to movement of the actuator and the other member is connected to the piston rod for common movement therewith and connected to the propulsion unit for effecting steering movement of the propulsion unit in response to movement of the other member.

The invention also provides a marine propulsion device including a propulsion unit, mounting means adapted to be mounted on a boat and connected to the propulsion unit for affording pivotal movement of the propulsion unit in opposite directions about a steering axis, a hydraulic cylinder-piston assembly connected to the propulsion unit for steering thereof and including an axis, a cylinder and piston mounted in the cylinder, with one of the cylinder and the piston being fixed against movement axially of the axis of the hydraulic cylinder-piston assembly and the other being axially movable relative to the one of the cylinder and said piston, and a control valve assembly including a valve housing and a valve member movable relative to each other between a turn-left position, a no-steering change position, and a turn-right position. The valve housing is adapted to be connected to a source of pressurized hydraulic fluid, is adapted to be connected to a hydraulic fluid pump, and is hydraulically connected to the opposite sides of the cylinder, the valve member has land means which are cooperable with the valve housing and are operable, when the valve assembly is in the no-steering change position, to connect the pressurized fluid source in fluid communication with the sump and with the opposite sides of the cylinder, which are operable, when the valve assembly is in the turn-left position, to connect the pressurized fluid source in fluid communication with one the side of the cylinder and to connect the other side of the cylinder in fluid communication with the sump, and which are operable, when the valve assembly is in the turn-right position, to connect the pressurized fluid source in fluid communication with the other side of the other cylinder and to connect the one side of the cylinder in fluid communication with the sump.

The invention also provides a marine propulsion device including a propulsion unit, mounting means adapted to be mounted on a boat and connected to the propulsion unit for affording pivotal steering movement of the propulsion unit in opposite directions about a steering axis and power assist means adapted to operably connect an actuator to the propulsion unit for increasing the steering force applied to the propulsion unit by the actuator. The power assist means includes a hydraulic cylinder-piston assembly having a cylinder, a piston mounted in the cylinder for reciprocative movement therein, and an extendable and retractable piston rod connected to said piston, and control means adapted to be connected to a source of pressurized hydraulic fluid for selectively controlling flow of hydraulic fluid to and from the opposite sides of the cylinder to extend and retract the piston rod. The control means has first and second members rotatably and axially movable relative to each other and one of these members is adapted to be connected to the actuator for axial movement relative to the other in response to movement of the actuator and the other member is connected to the piston rod for common movement therewith and is connected to the propulsion unit for effecting steering movement of the propulsion unit in response to movement of the other member.

One of the principal features of the invention is the provision of the marine propulsion device including a power steering system which is wholly supported on a mounting means mounted on a boat and connected to the propulsion unit to afford steering movement.

Another of the principal features of the invention is the provision of a marine propulsion device including a compact power steering system having a hydraulic cylinder-piston assembly and a control valve which is operated by an actuator including a push-pull cable to selectively extend and retract the piston rod and effect steering of the propulsion unit.

Another of the principal features of the invention is the provision of a marine propulsion device including a power steering system described in the next preceding paragraph wherein the control valve includes a valve member and a valve housing movable relative to each other and the valve member is axially movable on an axis generally coinciding with the propulsion unit tilt axis.

Another of the principal features of the invention is the provision of a marine propulsion device including a plurality of propulsion units and a power steering system for each unit which can be operated in unison by a single remote actuator and which is arranged to permit the propulsion units to tilt independently of each other.

Another of the principal features of the invention is the provision of a marine propulsion device including a plurality of propulsion units and a single power steering system for steering all the propulsion units.

Other features, aspects and advantages of the invention will become apparent to those skilled in the art upon reviewing the following detailed description, the drawings and the appended claims.

BRIEF DESCRIPTION OF THE DRAWINGS

FIG. 1 is a side view of an outboard motor embodying various of the features of the invention.

FIG. 2 is an enlarged, partially sectioned and partially schematic, top view of the power steering system in the outboard motor shown in FIG. 1.

FIG. 3 is an enlarged, fragmentary and schematic view of the control valve of the power steering system shown in FIG. 2.

Figure 8:
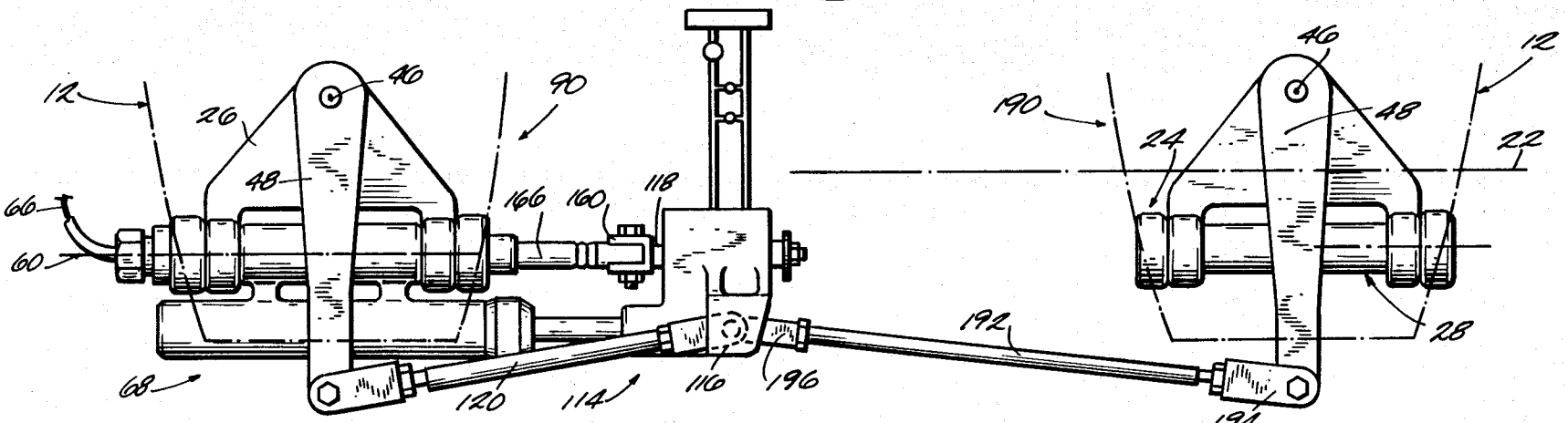
FIG. 8 is a view similar to FIG. 6 except the steering mechanism includes a single power steering system for steering both outboard motors.

Before explaining at least one of the embodiments of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and cerminology employed herein is for the purpose of description and should not be regarded as limiting.

DESCRIPTION OF THE PREFERRED EMBODIMENTS

Illustrated in the drawings is a marine propulsion device, such as an outboard motor or stern drive unit, incorporating various of the features of the invention. In the specific construction illustrated, the marine propulsion device 10 is the form of an outboard motor including a propulsion unit 12 having an upper power head 14 housing an internal combustion engine 16 and a lower unit 18 carrying a rotatably mounted propeller 20 which is connected to the engine 16 via a conventional transmission.

Means are provided for mounting the propulsion unit 12 on a boat transom 22 for vertical tilting movement about a generally horizontal axis and for pivotal movement in opposite directions about a steering axis generally transverse to the tilt axis. While various mounting means can be used, in the specific construction illustrated, such means includes a support or transom bracket 24 mounted on the boat transom 22 and a pivot or swivel bracket 26 pivotally connected to the transom bracket 24 via a horizontally extending pivot or tilt tube 28. More specifically, the transom bracket 24 has a pair of laterally spaced arms 30 and 32 including a bore 34 pivotally receiving the tilt tube 28.

The swivel bracket 26 has a pair of lugs 36 and 38 located adjacent the transom bracket arms 30 and 32 and including an aperture 40 receiving the tilt tube 28. The swivel bracket 26 tilts or pivots in a generally vertical plane relative to the transom bracket 24 about the horizontal axis 42 of the tilt tube 28, herein referred to as the tilt axis.

The propulsion unit 12 is connected to the swivel bracket 26 by a king pin 44 which affords pivotal swinging movement of the propulsion unit 12 in a generally horizontal plane relative to the swivel bracket 26 and in opposite directions about the generally vertical axis 46 of the king pin 44, herein referred to as the steering axis.

Means are provided for causing steering movement of the propulsion unit 12 about the steering axis 46. While various steering means can be used, in the specific construction illustrated, such means includes a tiller or steering arm 48 having a rearward portion affixed to the king pin 44 and the propulsion unit 12 and a forwardly extending arm portion 50 providing a lever arm for pivoting the king pin 44 and the propulsion unit 12 about the steering axis 46.

The steering means also includes a remotely located steering acutator or device 52 including a housing or frame 54 mounted on the boat hull and a shaft 56 rotatably carried by the frame 54 and supporting a steering wheel 58. The steering device 52 is connected to the arm portion 50 of the steering arm 48 via a steering cable assembly 60 to effect pivotal steering movement of the propulsion unit 12 in response to rotation of the steering wheel 58. In the specific construction illustrated, the steering cable assembly 60 includes an outer cable sheath 62 having one end secured to one end of the tilt tube 28 by a threaded member 64 and an inner flexible member or push-pull cable 66 which is movable relative to the sheath 62. One end of the push-pull cable 66 is operably connected to the steering wheel shaft 56.

Power assist means 67 operably connecting the steering device 52 to the propulsion unit 12 are provided for increasing the steering force applied to the steering arm 48 by the push-pull cable 66. In the specific construction illustrated, such power assist means or power steering system 67 is wholly supported on the swivel bracket 26 and includes a hydraulic cylinder-piston assembly 68 having an extendable and retractable steering link which is connected between one end of the push-pull cable 66 and the arm portion 50 of the steering arm 48 and which, when it extends or retracts, effects pivotal movement of the propulsion unit 12. The power steering system 67 also includes a control means for selectively extending and retracting the steering link in response to rotation of the steering wheel 58 and, thus, to axial movement of the push-pull cable 66.

The hydraulic cylinder-piston assembly 68 includes a cylinder 70 having a fixed, longitudinal axis 71 located in spaced parallel relationship to the tilt axis 42 and a piston 72 mounted inside the cylinder 70 for axial reciprocative movement. This piston 72 has a central aperture 73 and divides the cylinder 70 into opposite sides or first and second pressure chambers 74 and 76.

One end 78 of the cylinder 70 is closed by an end wall 80 including a central aperture 82, The inner end 84 of a tubular piston rod 86, slidably extending through the end wall aperture 82 and forming the steering link, is fixably connected to the piston 72 and the outer end 88 of the piston rod 86 extends outwardly from the cylinder 70. The piston rod 86 includes an outer tubular portion 90 and an inner tubular portion 92 which extends through the piston aperture 73 and forms a first flow passageway 94 communicating with the first pressure chamber 74. The inner tubular portion 92 is concentric with the outer tubular portion 90 and cooperates therewith to define an annular second flow passageway 96 which communicates with the second pressure chabmer 97 through apertures 98 in the outer tubular portion 90 near the piston 72.

The piston 72 is operated by a pressurized hydraulic fluid continuously supplied by a pump 100 which can be driven directly by the engine 16 or by another power source such as an electric motor (not shown) operated by a battery or by a generator driven by the engine 16. The pump 100 is connected to a sump or reservoir 104 by a conduit 106 and to the piston and cylinder assembly 68 by a supply conduit 102. Hydraulic fluid from the cylinder-piston assembly 68 is discharged to the reservoir 104 through a return conduit 108. In the event of excessive pressure, hydraulic fluid flows from the supply conduit 102 to the return conduit 108 via a conduit 110 and a vent or relief valve 112. The return conduit 110 is connected to the supply conduit 102 via a bypass 111 and a check valve 113.

Control means are provided for selectively controlling the the flow of hydraulic fluid to and from the first and second pressure chambers 74 and 76 to extend and retract the piston rod 86. In the specific construction illustrated, such means includes a control valve 114 including a first member or valve housing 116 and a second member or spool valve 118 movable relative to each other. The spool valve 118 is connected to the push-pull cable 66 and is axially movable relative to the valve housing 116 in response to movement of the push-pull cable 66. Axial movement of the piston rod 86 relative to the cylinder 70 is transmitted to the steering arm 48 to effect pivotal movement of the propulsion unit 12 about the steering axis 46 by rigid connection of the piston rod 86 and the valve housing 116 and by a rigid connecting link 120 having one end 122 pivotally connected to the arm portion 50 of the steering arm 48 and the opposite end 124 pivotally connected to the valve housing 116.

The valve housing 116 has an axially extending, generally cylindrical bore or cavity 126 in which the spool valve 118 is mounted for axial movement between a first or turn-left position and a second or turn-right position on the opposite sides of a third, center or no-steering change position best illustrated in FIG. 3. Hydraulic fluid is admitted to the cavity 126 through an inlet port 128 connected in communication with the supply conduit 102 and a central annular groove 130 in the valve housing 114. Hydraulic fluid is discharged from the cavity 126 through annular and grooves 132 and 134 in the valve housing 114 spaced on opposite sides of the central groove 130 and through respective return ports or passages 135 and 136 which merge into a single passage or combined return port 137 connected in communication with the return conduit 108.

Hydraulic fluid flows from the cavity 126 to the cylinder 70 and from the cylinder 70 to cavity 126 through intermediate annular grooves 138 and 140 and respective steering passages or ports 142 and 144 in the valve housing 114. The steering port 142 is connected in communication with the first passageway 94 of the piston rod 86 (i.e., the interior of the inner tubular portion 92) and the steering port 144 is connected in communication with the second flow passageway 96 of the piston rod 86 (i.e., the annular passage between the inner and outer tubular portions 92 and 90).

The spool valve 118 includes an enlarged, cylindrical central portion or land 146 and enlarged, cylindrical end portions or lands 148 and 150 spaced from the opposite sides of the central land 146. The lands 146, 148 and 150 slidably and sealingly engage the interior wall of the cavity 126 during axial movement of the spool valve 118.

Shoulder means are provided on the spool valve 118 for engaging the opposite ends of the valve housing 116 and mechanically connecting the push-pull cable 66 with the valve housing 118 in the event the power steering system fails. In the specific construction illustrated, the spool valve 118 includes opposite end portions 152 and 154 projecting outwardly from the opposite ends of the valve housing 116. One end 152 carries a washer 156 which is engageable with the valve housing 116 and is spaced therefrom a sufficient distance to accomodate axial movement of the spool valve 118 from the illustrated no-steering change position to a turn-left position described in more detail below. The washer 156 is held in place by a nut 158 threaded onto an outermost portion of the spool valve end 152.

The other end 154 of the spool valve 118 has a clevis 160 which is pivotally connected, by a bolt 162 and a nut 164, to a hollow member or ram 166 connected to the end of the push-pull cable 66 and guided for relative axial movement inside the tilt tube 128. Axial movement of the push-pull cable 66 and the ram 166 in response to rotation of the steering wheel 58 causes axial movement of the spool valve 118 relative to the valve housing 116. Similar to the washer 156, the outer surface 168 of the clevis 160 is engageable with the end of the valve housing 116 and is spaced therefrom a sufficient distance to accomodate axial movement of the spool valve 118 from the no-steering change position to a turn-right position described in more detail below.

When the spool valve 118 is in the no-steering change position, the central land 146 partially covers or blocks the central groove 130 and the end lands 148 and 150 partially cover or block the respective end grooves 132 and 134. Pressurized hydraulic fluid flows into the central groove 130 from the inlet port 128 and past the opposite edges of the central land 146 into the cavity 126. The first pressure chamber 74 is in fluid communication with the cavity 126 via the first passageway 94, the steering port 142 and the intermediate groove 138. The second pressure chamber 76 is in fluid communication with the cavity 126 via the apertures 98, the second passageway 96, the steering port 144 and the intermediate groove 140. Thus, both sides of the piston 72 are exposed to pressurized fluid when the spool valve 118 is in the no-steering change position.

When the push-pull cable 66 is not being moved, extension or retraction of the piston rod 86 causes the valve housing 116 to move axially relative to the spool valve 118. The area of the piston side facing the first pressure chamber 74 is larger than the area of the side facing the second pressure chamber 76 by virtue of the space occupied by the piston rod 86. Thus, when the spool valve 116 is moved to the center or no-steering change position, the piston rod 86 tends to extend and move the valve housing 116 to the right as viewed in FIG. 3 until the pressure acting on the opposite sides of the piston 72 are balanced to produce substantially equal pressure forces on both sides of the piston 72. That is, the size of the opening between the left edges of the central land 146 and the central groove 130 is reduced, thereby reducing the hydraulic pressure supplied to the first pressure chamber 74, while the size of the opening between the right edges of the central land 146 and the central groove 130 is increased, thereby increasing the hydraulic pressure applied to the second pressure chamber 76.

External forces acting upon the propulsion unit 12 tending to pivot it about the steering axis 46 are resisted in a similar manner. For example, a force tending to pivot the propulsion unit 12 counterclockwise as viewed in FIG. 2 would tend to move the valve housing 116 to the right and increase the opening between the right edges of the central land 146 and the central groove 130 while decreasing the opening between the left edges of the central land 146 and the central groove 130. This would increase the pressure in the second pressure chamber 76 for resisting extension of the piston rod 86.

The pump 100 operates continuously during operation of the propulsion unit 12. Consequently, when the spool valve 118 is in the no-steering change position, a portion of the hydraulic fluid flows from the cavity 126 out through the return ports 135, 136 and 137 and is returned to the reservoir 104 through the return conduit 108.

As the spool valve 118 is moved to the right relative to the valve housing 116, or to the turn-right position, by a pushing movement on the push-pull cable 66, the left end land 148 covers the left end groove 132, the right end land 150 completely uncovers the right end groove 134, and the central land 146 completely uncovers and moves to the right of the central groove 130. A first passage means comprising the central groove 130, the cavity 126, the steering port 142 and the first flow passageway 94 in the piston rod 86 connects the first pressure chamber 74 in fluid communication with the inlet port 128. This first passage means further comprising the return port 136, the right end groove 134, the cavity 126, the steering port 144, the second glow passageway 96 in the piston rod 86, and the apertures 98 connect the second pressure chamber 76 in fluid communication with the combined return port 137.

As a consequence of the above connections, the piston rod 86 is extended and the valve housing 116 is moved to the right, causing the propulsion unit 12 to be pivoted in a counter clockwise direction about the steering axis 46 via the connecting link 120 and the steering arm 148. As the piston rod 86 extends, the valve housing 116 is moved axially to the right relative to the spool valve 118 and continues to move to the right until it reaches the no-steering change position, at which time the pressure force acting on the opposite sides of the piston 72 are balanced as described above. The piston 86 is maintained in a position corresponding to the turned position of the steering wheel 58 until the steering wheel is subsequently rotated to change the direction of boat travel.

When the spool valve 118 is moved to the left relative to the valve housing 116 to the turn-left position by a pulling movement on the push-pull cable 66, the right end land 150 covers the right end groove 136, the left end land 148 completely uncovers the left end groove 132, and the central land 146 uncovers and moves to the left of the central groove 130. A second passage means comprising the central groove 130, the cavity 126, the steering port 144, the second flow passageway 96 and the apertures 98 connect the second pressure chamber 76 in fluid communication with the inlet port 128. This second passage means further comprising the return port 135, the left end groove 132, the cavity 126, the steering port 142 and the first passageway 94 connects the first pressure chamber 74 in fluid communication with the combined return port 137.

As a consequence of the above connections, the piston rod 86 is retracted and the valve housing 116 is moved to the left, causing the propulsion unit 12 to be rotated in a clockwise direction about the steering axis 46 until the valve housing 116 reaches the no-steering change position relative to the spool valve 118 as described above.

When the spool valve 118 is in the no-steering change position, a third passage means comprising the central groove 130, the cavity 126, the intermediate groove 136, the steering port 142 and the first passageway 94 and also comprising the intermediate groove 140, the steering port 144, the second passageway 96 and the apertures 98 connect both the first and second pressure chambers 74 and 76 in fluid communication with the inlet port 128 and produce substantially equal pressure forces on the opposite sides of the piston 72 as described above.

Means are provided for mounting the piston cylinder assembly 68 for common tilting movement with the propulsion unit 12 about the tilt axis 42 and for preventing or restraining axial movement in a direction parallel to the tilt axis 42. While various suitable arrangments can be used, in the specific construction illustrated, the piston and cylinder assembly 68 includes an integral cylindrical part 170 rotatably receiving the tilt tube 28 and disposed between the swivel bracket lugs 36 and 38. Common tilting movement of the piston-cylinder assembly 68 can be obtained by dimensioning the part 170 so that it provides a press fit with the swivel bracket lugs 36 and 38.

Figure 4:
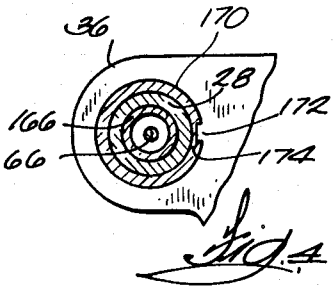
FIG. 4 is a sectional view taken generally along line 4—4 in FIG. 3.

Alternatively, interengaging means can be provided on the part 170 and the swivel bracket lugs 36 and 38. For example, as illustrated in FIG. 4, one or both of the swivel bracket lugs 36 and 38 can be provided with a protuberance 172 which is received in a groove 174 on one side of the part 170 when the part 170 is fitted between the swivel bracket lugs 36 and 38 during assembly.

In operation, with the steering wheel 58 centered and the propulsion unit 12 in a straight ahead position, pressurized hydraulic fluid is supplied to both the first and second pressure chambers 74 and 76 and the piston rod 86 is maintained in a no-steering change position as described above. When the steering wheel 58 is turned to the left, the push-pull cable 66 and the ram 166 is pulled to the left and the spool valve 118 is moved to the left to the turn-left position to connect the second pressure chamber 76 in fluid communication with the inlet port 128 and to connect the second pressure chamber 76 in fluid communication with the return ports 135 and 137 as described above.

Consequently, the piston rod 86 is retracted, causing the valve housing 116 to move to the left relative to the piston and cylinder assembly 68 and thereby pivoting the propulsion unit clockwise about the steering axis 46 to turn the boat to the left. At the same time, the valve housing 116 moves axially relative to the spool valve 118 until it reaches a position corresponding to the third or center position of the spool valve 118. The steering action is then terminated and the propulsion unit 12 is maintained in the turned position as described above until the steering wheel 58 is again turned.

When the steering wheel 58 is turned to the right, the push-pull cable 66 and the ram 166 is pushed to the right and the spool valve 118 is moved to the right to the turn-right position to connect the first pressure chamber 74 in fluid communication with the inlet port 128 and to connect the second pressure chamber 76 in fluid communication with the outlet ports 136 and 137 as described above. Consequently, the piston rod 86 is extended, causing the valve housing 116 to move to the right relative to the piston and cylinder assembly 68 and thereby pivoting the propulsion unit 12 to turn the boat to the left. The valve housing 116 moves to the centered position and the propulsion unit 12 is maintained in the turned position until the steering wheel 58 is again turned as described above.

If the piston 72 bottoms against the cylinder in either direction, the relief valve 112 opens to limit the hydraulic pressure supplied to the power assist or steering system to a predetermined level.

The propulsion unit 12 can be steered manually in the event the power steering system fails. As the push-pull cable 66 is moved to the left, the washer 156 will eventually engage one end of the valve housing 116 and cause it to be mechanically moved to the left in a manner similar to movement of the spool valve 118 by the push-pull cable 66 and the ram 166. This movement of the valve housing 116 causes the propulsion unit 12 to be pivoted clockwise via the connecting link 120. Similarly, the outer surface 168 of the clevis 160 will engage the valve housing 116 and cause the propulsion unit 12 to pivot counterclockwise as the spool valve 118 is moved to the right by the push-pull cable 66 and the ram 166.

Hydraulic fluid displaced from the cylinder 70, as the piston rod 86 is extended or retracted in response to movement of the valve housing 116, is discharged from the control valve 114 through the combined return port 137 and flows through the bypass conduit 111 and the check valve 113 back to the supply conduit 102.

It should be understood that the cylinder-piston assembly 68 can be arranged so that the piston 72 is fixed against movement axially of the cylinder-piston assembly axis and the cylinder 70 is axially movable relative to the piston 72. Also, the control valve 114 and the connections between the cylinder-piston assembly 68 and the propulsion unit 82 can be arranged so that the spool valve 118 is connected to the piston rod 86 or the cylinder 70 and the valve housing 114 is connected to the push-pull cable 66.

Figure 5:
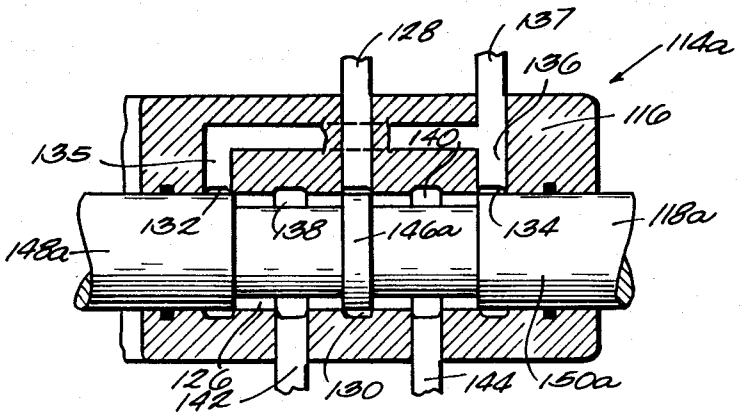
FIG. 5 is a view similar to FIG. 3 of an alternate construction for the control valve in the power steering system.

FIG. 5 illustrates an alternative construction for the control valve **114*a* and components common with those in the control valve 114 illustrated in FIG. 3 are designated by the same reference numerals. In this alterante construction, the spool valve 118*a* is arranged so that the central land 146*a* completely covers the central groove 130 and the end lands 148*a* and 150*a* completely cover the respective end groovs 132 and 134 when the spool valve 188*a* is in the third or no-steering change position. The power steering system operates in substantially the same manner when the spool valve 118*a* is in the turn-left and turn-right positions and the first and second pressure chambers 74 and 76 are alternately connected to the inlet port 128 and the combined return port 137** by passage means like the first and second passage means described above.

When the spool valve **118*a* is in the no-steering change position illustrated in FIG. 5, the central groove 130 communicating with the inlet port 128 and the end grooves 132 and 134 communicating with the combined return port 137 are blocked. Thus, communication is prevented between the first and second pressure chambers 74 and 76 and either the inlet port 128 or the combined return port 137. Consequently, hydraulic fluid from the pump 100 flows through the relief valve 112 and through the return conduit 108 to the reservoir 104. Hydraulic fluid is trapped in the cavity 126, the steering ports 142 and 144, the first and second passageways 94 and 96, and the first and second pressure chambers 74 and 76. The substantially incompressible hydraulic fluid prevents the piston 72, and thus the propulsion unit 12, from being moved until the spool valve 118*a*** is moved from the no-steering change position toward either the turn-left position or the turn-right position.

Figure 6:
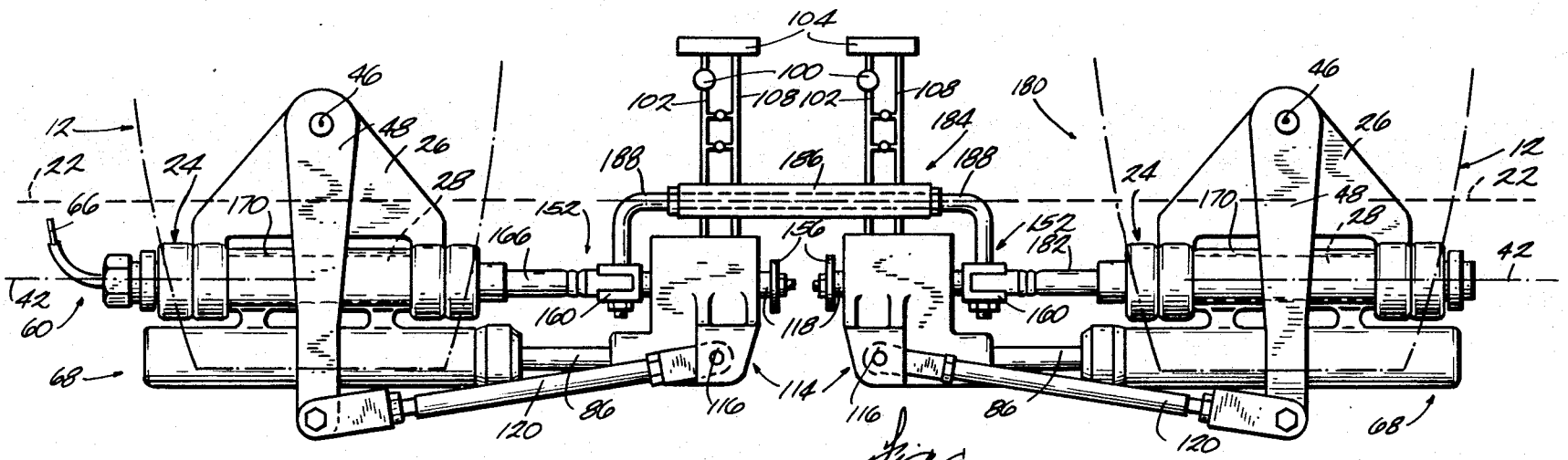
FIG. 6 is a top view of a power steering system for two outboard motors mounted in side-by-side relationship.
Figure 7:
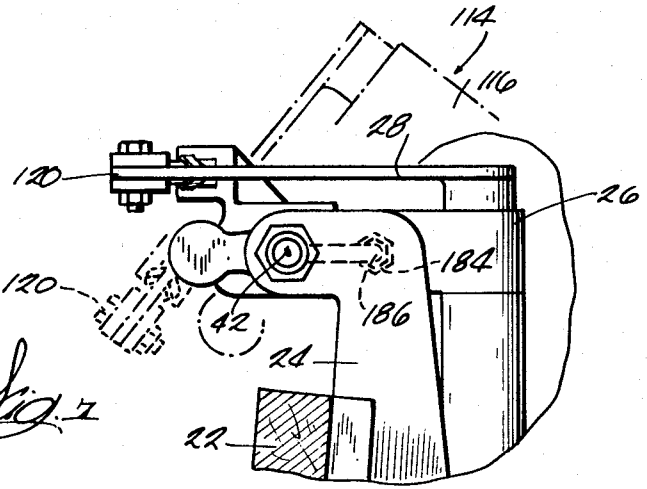
FIG. 7 is an end view taken generally along line 7—7 in FIG. 6 showing the relative position of certain parts when one propulsion unit is in a tilted position and the other is in an operating position.

In the embodiment illustrated in FIGS. 6 and 7, a plurality, e.g., two, of outboard motors 180 are mounted on a boat transom 22 in side-by-side relationship. Each outboard motor 180 includes a propulsion unit 12 like that described above supported from the boat transom 22 by a transom bracket 24 and a swivel bracket 26 for tilting movement about a generally horizontal tilt axis and steering movement about a generally vertical steering axis.

Each propulsion unit 12 includes a power steering system similar to that described above. More specifically, each power steering includes a cylinder-piston assembly 68 having a part 170 rotatably receiving a tilt tube 28, a control valve 114 having a valve housing 116 connected to a piston rod 86, a connecting link 120 connecting the valve housing 116 to a steering arm 48 on the propulsion unit 12, and a spool valve 118 for controlling the flow of hydraulic fluid to the piston and cylinder assembly 68 in response to relative axial movement of the spool valve 118 and the valve housing 116.

The power steering systems are oppositely arranged so that both can be operated by a single actuator or steering device. One end of the spool valve 118 for the left propulsion unit 12 is connected to a boat steering device, such as a steering wheel like that show in FIG. 2, by a steering cable assembly 60 including a push-pull cable 66 and a ram 166 extending through the tilt tube 28 and connected to a clevis 160 on the spool valve 118. Axial movement of the push-pull cable 66 and the ram 166 in response to operation of the steering device moves the spool valve 118 to selectively extend and retract the piston rod 86 as described above.

One end 152 of the spool valve 118 for the right propulsion unit 12 is connected, via the respective clevis 160, to a rod 182 slidably received in the respective tilt tube 28.

Means are provided for interconnecting the spool valves 118 so that they move in unison in response to movement of the push-pull cable 66 and the ram 166 and both the propulsion units 12 are pivoted in the same direction. While various arrangements can be used, in the specific construction illustrated, the spool valves 118 are mechanically connected together by a rigid connecting link or tie bar assembly 184 including a horizontally extending bar or rod 186 and a pair of L-shaped leg members 188. Each leg number 188 has one end connected to the respective spool valve clevis 160 and the other end connected to the rod 186.

In operation, when the push-pull cable 66 and the ram 166 is pulled to the left in response to rotation of the steering wheel, the spool valve 118 for the left propulsion unit is moved to the left to the turn-left position as described above. The spool valve 118 on the right propulsion unit is also moved to the left via the tie bar assembly 184. However, it is moved to the second position described above because the control valve 114 is oppositely arranged or oriented 180° from the control valve 114 on the left propulsion unit. Consequently, the piston rod 86 on the right propulsion unit 12 is extended and each propulsion unit is pivoted in clockwise direction about the respective steering axis 46. The opposite action of the piston rod 86 occurs to provide opposite pivotal movement of the propulsion units when the push-pull cable 66 and the ram 166 are moved to the right.

In the event either power steering system fails, the washers 156 and the clevises 160 on the spool valves 118 permit the propulsion units 12 to be steered manually as described above.

The power steering systems are provided with means permitting the propulsion units to be tilted independently of each other, even though the spool valves are mechanically linked together to steer the propulsion units in unison. In the specific construction illustrated, each valve housing 116 and spool valve 118 is rotatable relative to each other, in addition to being axially movable relative to each other, and the longitudinal axis of each spool valve 118 generally coincides with the tilt axis 42. Thus, a valve housing 116 can rotate about the respective spool valve 118 when one of the propulsion units 12 is tilted relative to the other as illustrated by the dashed lines in FIG. 7.

The leg members 188 of the tie bar assembly 184 preferably are adjustably connected to the rod 186, for example, threaded into the rod 186, so that the length of the tie bar can be adjusted to accomodate variation in lateral spacing between the propulsion units and to adjust the amount of toe-in and toe-out between the two propulsion units 12.

FIG. 8 illustrates an alternate arrangement of a power steering mechanism for a plurality, e.g., 2, of outboard motors 190 mounted on a boat transom 22 in side-by-side relationship similar to the embodiment shown in FIGS. 6 and 7, but steered with a single power steering system. In this embodiment, the spool valve 118 for the left propulsion unit 12 is connected to the steering device and operates like that for the left propulsion unit in the embodiment illustrated in 6 and 7. Means are provided for connecting adjacent propulsion units together for common steering movement of all the propulsion units in response to movement of the push-pull cable 66. In the specific construction illustrated, the right propulsion unit 12 is mechanically connected to the left propulsion unit 12 by a link 192 pivotally connected at the one end 194 to the steering arm 48 on the right propulsion unit 12 and pivotally connected at the other end 196 to the valve housing 116 on the left propulsion unit 12, so that, during steering movement of the left propulsion unit 12, the right propulsion unit 12 is moved in unison therewith. Alternately, a similar link can be connected between the steering arms of adjacent propulsion units.

While the preferred embodiment utilizes a push-pull cable to axially displace the spool valve 118, other means, such as for example a hydraulically operated mechanism, can be employed.

Various of the features of the invention are set forth in the following claims.

I claim:

1. A marine propulsion device comprising a propulsion unit, mounting means adapted to be mounted on a boat and connected to said propulsion unit for affording tilting movement of said propulsion unit about a generally horizontal tilt axis and pivotal steering movement of said propulsion unit in opposite directions about a steering axis transverse to the tilt axis, a hydraulic cylinder-piston assembly having an axis extending in fixed, parallel relation to the tilt axis and including a cylinder and a piston mounted in said cylinder and dividing said cylinder into opposite sides, one of said cylinder and said piston being fixed against movement axially of the hydraulic cylinder piston assembly axis and the other of said cylinder and said piston being axially movable relative to said one of said cylinder and said piston, a control valve assembly including a valve member and a valve housing movable relative to each other, said valve housing being adapted to be connected to a source of pressurized hydraulic fluid and being hydraulically connected to said opposite sides of said cylinder, said valve member and said valve housing being movable relative to each other to control flow of hydraulic fluid from the source thereof to said cylinder, means connecting one of said valve housing and said valve member with said other of said cylinder and said piston for common movement, means connected to the other of said valve housing and said valve member for displacing said other of said valve member and said valve housing relative to said one of said valve housing and said valve member in response to operator activity, and means connecting said propulsion unit to said other one of said cylinder and said piston for effecting steering movement of said propulsion unit in response to movement of said other of said cylinder and said piston incident to the application of pressurized hydraulic fluid to said cylinder by said control valve assembly.

2. A marine propulsion device according to claim 1 when said valve member and said valve housing are rotatably and axially movable relative to each other and said valve member is axially movable on an axis generally coinciding with the tilt axis.

3. A marine propulsion device comprising a propulsion unit, mounting means adapted to be mounted on a boat and connected to said propulsion unit for affording tilting movement of said propulsion unit about a generally horizontal tilt axis and pivotal steering movement of said propulsion unit in opposite directions about a steering axis transverse to the tilt axis, a hydraulic cylinder-piston assembly including a cylinder and a piston mounted in said cylinder and dividing said cylinder into opposite sides, one of said cylinder and said piston being fixed against movement axially of the hydraulic cylinder-piston assembly axis and the other of said cylinder and said piston being axially movable relative to said one of said cylinder and said piston, a control valve assembly including a valve member and a valve housing rotatably and axially movable relative to each other, said valve member being axially movable on an axis generally coinciding with the tilt axis, said valve housing being adapted to be connected to a source of pressurized hydraulic fluid and being hydraulically connected to said opposite sides of said cylinder, said valve member and said valve housing being movable relative to each other to control flow of hydraulic fluid from the source to said cylinder, means connecting one of said valve housing and said valve member with said other of said cylinder and said piston for common movement, means connected to the other of said valve housing and said valve member for displacing said other of said valve member and said valve housing relative to said one of said valve housing and said valve member in response to operator activity, and means connecting said propulsion unit to said other one of said cylinder and said piston for effecting steering movement of said propulsion unit in response to movement of said other of said cylinder and said piston incident to the application of pressurized hydraulic fluid to said cylinder by said control valve assembly.

4. A marine propulsion device comprising a propulsion unit, mounting means adapted to be mounted on a boat and connected to said propulsion unit for affording tilting movement of said propulsion unit about a generally horizontal tilt axis and pivotal steering movement of said propulsion unit in opposite directions about a steering axis transverse to the tilt axis, a hydraulic cylinder-piston assembly including a cylinder and a piston mounted in said cylinder and dividing said cylinder into opposite sides, one of said cylinder and said piston being fixed against movement in the direction axially of the hydraulic cylinder-piston assembly axis and being wholly supported on said mounting means and the other of said cylinder and said piston being axially movable relative to said one of said cylinder and said piston, a control valve assembly including a valve member and a valve housing movable relative to each other, said valve housing being adapted to be connected to a source of pressurized hydraulic fluid and being hydraulically connected to said opposite sides of said cylinder, said valve member and said valve housing being movable relative to each other to control flow of hydraulic fluid from the source to said cylinder, means connecting one of said valve housing and said valve member with said other of said cylinder and said piston for common movement, means connected to the other of said valve housing and said valve member for displacing said other of said valve member and said valve housing relative to said one of said valve housing and said valve member in response to operator activity, and means connecting said propulsion unit to said other of said cylinder and said piston for effecting steering movement of said propulsion unit in response to movement of said other of said cylinder and said piston incident to the application of pressurized hydraulic fluid to said cylinder by said control valve assembly.

5. A marine propulsion device according to claim 4 wherein said valve member and said valve housing are rotatably and axially movable relative to each other and wherein said valve member is axially movable on an axis generally coinciding with the tilt axis.

6. A marine propulsion device comprising a propulsion unit, mounting means adapted to be mounted on a boat and connected to said propulsion unit for affording pivotal steering movement of said propulsion unit in opposite directions about a steering axis and power assist means adapted to operably connect an actuator to said propulsion unit for increasing the steering force applied to said propulsion unit by the actuator, said power assist means being wholly supported on said mounting means and including a hydraulic cylinder piston assembly including a cylinder, a piston mounted in said cylinder for reciprocative movement therein and an extendable and retractable piston rod connected to said piston, and control means for selectively extending and retracting said piston rod, said control means having first and second members axially movable relative to each other, one of said members being adapted to be connected to the actuator for axial movement relative to the other of said members in response to movement of the actuator and said other member being connected to said piston rod for common movement therewith and connected to said propulsion unit for effecting steering movement of said propulsion unit in response to movement of said other member.

7. A marine propulsion device according to claim 6 wherein said mounting means is further connected to said propulsion unit for affording tilting movement of said propulsion unit about a generally horizontal tilt axis and wherein said second member is axially movable on an axis generally coinciding with the tilt axis.

8. A marine propulsion device according to claim 7 wherein the actuator includes a push-pull cable including a portion extending generally coincidentially with the tilt axis and operably connected to said second member.

9. A marine propulsion device comprising a propulsion unit, mounting means adapted to be mounted on a boat and connected to said propulsion unit for affording pivotal tilting movement of said propulsion unit about a tilt axis and for affording pivotal steering movement of said propulsion unit in opposite directions about a steering axis, a hydraulic cylinder-piston assembly having an axis extending in transverse relation to the steering axis and including a cylinder and a piston mounted in said cylinder and dividing said cylinder into opposite sides, one of said cylinder and said piston being fixed to said mounting means and against movement in the direction axially of the axis of said hydraulic cylinder-piston assembly and the other of said cylinder and said piston being movable in the axial direction relative to said one of said cylinder and said piston, means connecting said propulsion unit to said other of said cylinder and said piston for effecting steering movement of said propulsion unit in response to movement of said other of said cylinder and said piston incident to the application of pressurized hydraulic fluid to said cylinder, and a control valve assembly including a valve housing and a valve member movable relative to each other on an axis coincident to said tilt axis and between a turn-left position, a no-steering change position, and a turn-right position, said valve housing being adapted to be connected to a source of pressurized hydraulic fluid, being adapted to be connected to a hydraulic fluid sump, and being hydraulically connected to said opposite sides of said cylinder, said valve member having land means which are co-operable with said valve housing and are operable, when said valve assembly is in said no-steering change position, to connect the pressurized fluid source in fluid communication with the sump and with said opposite sides of said cylinder, which are operable, when said valve assembly is in said turn-left position, to connect the pressurized fluid source in fluid communication with one of said opposite sides of said cylinder and to connect the other of said opposite sides of said cylinder in fluid communication with the sump, and which are operable, when said valve assembly is in said turn-right position, to connect the pressurized fluid source in fluid communication with said other side of said cylinder and to connect said one side of said cylinder in fluid communication with the sump.

10. A marine propulsion device comprising a propulsion unit, mounting means adapted to be mounted on a boat and connected to said propulsion unit for affording pivotal tilting movement of said propulsion unit about a tilt axis and for affording pivotal steering movement of said propulsion unit in opposite directions about a steering axis, a hydraulic cylinder-piston assembly having an axis extending in transverse relationship to the steering axis and including a cylinder and a piston mounted in said cylinder and dividing said cylinder into opposite sides, one of said cylinder and said piston being fixed to said mounting means and against movement in the direction axially of the hydraulic cylinder-piston assembly and the other of said cylinder and said piston being movable in the axial direction relative to said one of said cylinder and said piston, means connecting said propulsion unit to said other of said cylinder and said piston for effecting steering movement of said propulsion unit in response to movement of said other of said cylinder and said piston incident to the application of pressurized hydraulic fluid to said cylinder, and a control valve assembly including a valve housing and a valve member movable relative to each other on an axis coincident to said tilt axis and between a turn-left position, a no-steering change position, and a turn-right position, said valve housing including an inlet port adapted to be connected to a source of pressurized hydraulic fluid, first and second return ports adapted to be connected to a hydraulic fluid sump, and first and second steering ports connected in fluid communication with said opposite sides of said cylinder, said valve member having land means which are cooperable with said valve housing and are operable, when said valve assembly is in said no-steering change position, to connect said inlet port in fluid communication with each of said return ports and with each of said steering ports, which are operable, when said valve assembly is in said turn-left position, to connect said inlet port in communication with said first steering port, to connect said second steering port in communication with said second return port, and to block said first return port, and which are operable, when said valve assembly is in said turn-right position, to connect said inlet port in communication with said second steering port, to connect said first steering port in communication with said first return port, and to block said second return port.

11. A marine propulsion device comprising a propulsion unit, mounting means adapted to be mounted on a boat and connected to said propulsion unit for affording pivotal steering movement of said propulsion unit in opposite directions about a steering axis and power assist means adapted to operably connect an actuator to said propulsion unit for increasing the steering force applied to said propulsion unit by the actuator, said power assist means including a hydraulic cylinder-piston assembly having a cylinder, a piston mounted in said cylinder for reciprocative movement therein and dividing said cylinder into opposite sides, and an extendable and retractable piston rod connected to said piston, and control means adapted to be connected to a source of pressurized hydraulic fluid for selectively controlling flow of the hydraulic fluid to and from said opposite sides of said cylinder to extend and retract said piston rod, said control means having first and second members axially movable relative to each other, one of said members being adapted to be connected to the actuator for axial movement relative to the other of said members in response to movement of the actuator and the other of said members being connected to said piston rod for common movement therewith and connected to said propulsion unit for effecting steering movement of said propulsion unit in response to movement of said other member.

12. A marine propulsion device according to claim 11 wherein said mounting means is further connected to said propulsion unit for affording tilting movement of said propulsion about a generally horizontal tilt axis and wherein said second member is axially movable on an axis generally coinciding with the tilt axis.

13. A marine propulsion device according to claim 12 wherein said first member is connected to said piston rod and to said propulsion unit and effects pivotal steering movement of said propulsion unit in response to extension and retraction of said piston rod and wherein said second member is connected to the actuator and is movable relative to said first member between first and second positions in response to movement of the actuator, said control means causing said piston rod to extend when said second member is in the first position and causing said piston rod to retract when said second member is in the second position.

14. A marine propulsion device according to claim 13 wherein said second member is movable to a third position and wherein said control means prevents said piston rod from extending or retracting when said second member is in the third position.

15. A marine propulsion device according to claim 14 wherein said control means provides substantially balanced pressure forces on the opposite sides of said piston when said second member is in the third position.

16. A marine propulsion device according to claim 14 wherein said control means prevents hydraulic fluid in said cylinder from discharging from either side of said piston.

17. A marine propulsion device according to claim 13 wherein said second member includes first and second shoulder means which are adapted to engage said first member and mechanically connect said first member with the actuator in response to movement of the actuator in the opposite directions in the event of a failure preventing extensions or retraction of said piston rod by the hydraulic fluid.

18. A marine propulsion device comprising a propulsion unit, mounting means adapted to be mounted on a boat and connected to said propulsion unit for affording tilting movement of said propulsion about a generally horizontally tilt axis and for pivotal movement in opposite durections about a steering axis generally transverse to the tilt axis, and power assist means adapted to operably connect an actuator to said propulsion unit for increasing the steering force applied to said propulsion unit by the actuator, said power assist means including a cylinder mounted on said propulsion unit in spaced parallel relationship to said tilt axis for common tilting movement with said propulsion unit about the tilt axis and against axial movement in a direction parallel to the tilt axis, a piston slidably mounted for reciprocative movement inside said cylinder and dividing said cylinder into opposed first and second pressure chambers, a piston rod slidably extending through one end of said cylinder and having a first end connected to said piston rod and a second end extending outwardly from said cylinder, a control valve having a valve housing affixed to said second end of said piston rod for common movement therewith. having an inlet port adapted to be connected to a source of pressurized hydraulic fluid, a return port adapted to be connected to a hydraulic sump, and a valve member mounted in said valve housing for movement relative to said valve housing between first and second positions, means connecting said valve member to the actuator for movement of said valve member relative to said valve housing in response to movement of the actuator, means connecting said valve housing to said propulsion unit for effecting pivotal steering movement of said propulsion unit in response to movement of said valve housing relative to said valve member first passage means in said valve housing and said piston rod connecting said first chamber in communication with said inlet port and connecting said second chamber in communication with said return port to extend said piston rod and pivot said propulsion unit in one direction when said valve member is in the first position, and second passage means in said valve housing and said piston rod connecting said first chamber in communication with said return port and connecting said second chamber in communication with said inlet port to retract said piston rod and pivot said propulsion unit in the opposite direction when said valve member is in the second position.

19. A marine propulsion device according to claim 18 wherein said valve member is movable to a third position and wherein said device includes third passage means in said valve housing and said piston rod for connecting both said first and second pressure chambers in commmunication with said inlet port and providing substantially equal pressure forces on the opposite sides of said piston to prevent pivotal movement of said propulsion unit when said propulsion unit is in the third position.

20. A marine propulsion device according to claim 19 wherein said mounting means includes a support bracket supported from a boat transom and a swivel bracket pivotally connecting said support bracket and said propulsion unit for tilting movement, said swivel bracket including a pair of laterally spaced lugs, and wherein said cylinder includes a part disposed between and engageable with said swivel bracket lugs to restrain axial movement of said cylinder in a direction parallel to the tilt axis.

21. A marine propulsion device according to claim 20 wherein said mounting means includes a tilt tube extending between said swivel bracket lugs and supported from said swivel bracket to define the tilt axis and wherein said cylinder part is tubular and rotatably receives said tilt tube.

22. A marine propulsion device according to claim 21 wherein said means connecting said valve member to the actuator includes an axially movable actuation member extending through said tilt tube and connected to said valve member.

23. A marine propulsion device according to claim 22 wherein the actuation member includes a push-pull cable.

24. A marine propulsion device according to claim 22 wherein said actuation member includes a hydraulic cylinder.

25. A marine propulsion device according to claim 18 wherein said valve member is movable to a third position and wherein said valve housing and said valve member are arranged to prevent communication of both said first and second chambers with either said inlet port or said outlet port.

26. A marine propulsion device according to claim 18 and including interengaging means on said cylinder part and said swivel bracket lugs for providing common rotational movement of said cylinder and said swivel bracket about said tilt axis.

27. A marine propulsion device according to claim 18 wherein said power assist means is wholly supported on said propulsion unit.

28. A marine propulsion device according to claim 18 wherein said valve member and said valve housing are rotatably and axially movable relative to each other and said valve member is axially movable on an axis generally coinciding with the tilt axis.

29. A marine propulsionn device according to claim 18 wherein said valve member includes first and second shoulder means which are adapted to engage said valve housing and mechanically connect the actuator with said valve housing in response to movement of the actuator in opposite directions in the event of a failure preventing extension or retraction of said piston rod and by the hydraulic fluid.

30. A marine propulsion device comprising a plurality of propulsion units in side-by-side relationship, mounting means for each of said propulsion units, said mounting means being adapted to be mounted on a boat and connected to a respective propulsion unit for affording tilting movement about a generally horizontal tilt axis and for affording pivotal steering movement in opposite directions about a steering axis generally transverse to the tilt axis, and power assist means adapted to operably connect an actuator to said propulsion units for increasing the steering force applied to said propulsion units by the actuator, said power assist means including a like plurality of hydraulic cylinder-piston assemblies each having a cylinder, a piston mounted in said cylinder for reciprocative movement therein, and an extendable and retractable piston rod connected to said piston, means connecting each of said piston rods to the respective propulsion unit for effecting pivotal steering movement of the respective propulsion unit in response to extension and retraction of said piston rod, control means for each of said propulsion units for selectively extending and retracting the respective piston rod in response to movement of the actuator, said control means each including a first member which is connected to the respective piston rod and to the respective propulsion unit and which effects pivotal steering movement of the respective propulsion unit in response to extension and retraction of the respective piston rod, and a second member movable relative to said first member between first and second positions to cause the respective piston rod to move in one direction when said second member is in the first position and to cause the respective piston rod to move in the opposite direction when said second member is in the second position, means connecting one of said second members to the actuator for moving said one second member relative to the respective first member in response to movement of the actuator, means mechanically connecting said second members together for common movement in response to movement of the actuator, adjacent of said control means being mounted in opposite relationship so that movement of the actuator causes all of said piston rods to move in one direction and all of said propulsion units to move in the same direction about the respective steering axes.

31. A marine propulsion device according to claim 30 wherein said means mechanically connecting said second members comprises a rigid connecting link having opposite ends connected to said second members of adjacent propulsion units, and wherein said first and second members are axially and rotatably movable relative to each other and the longitudinal axes of said second members coincide with the respective tilt axis.

32. A marine propulsion device according to claim 31 wherein said connecting link includes means for adjusting the length thereof to vary the toe-in or toe-out of adjacent propulsion units.

33. A marine propulsion device comprising a plurality of propulsion units in side-by-side relationship, mounting means for each of said propulsion units, said mounting means being adapted to be mounted on a boat and connected to a respective propulsion unit for affording pivotal steering movement of the respective propulsion unit in opposite directions about a steering axis, and power assist means adapted to operably connect an actuator to one of said propulsion units for increasing the steering force applied to said propulsion unit by the actuator, said power assist means including a hydraulic cylinder-piston assembly having a cylinder, a piston mounted in said cylinder for reciprocative movement therein, and an extendable and retractable piston rod connected to said piston, control means for selectively extending and retracting said piston rod, said control means having first and second members rotatably and axially movable relative to each other, one of said members being adapted to be connected to the actuator for axial movement relative to the other of said members in response to movement of the actuator and said other member being connected to said piston rod for common movement therewith and connected to said one propulsion unit for effecting steering movement thereof in response to movement of said other member, and means connecting said propulsion units together for common steering movement of all of said propulsion units in the same direction in response to movement of the actuator.

34. A marine propulsion device comprising a propulsion unit, mounting means adapted to be mounted on a boat and connected to said propulsion unit for affording tilting movement of said propulsion unit about a generally horizontal tilt axis and pivotal steering movement of said propulsion unit in opposite directions about a steering axis, transverse to the tilt axis and a power assist means wholly supported on said mounting means, said power assist means including a hydraulic cylinder-piston assembly having an axis and including a cylinder and a piston mounted in said cylinder and dividing said cylinder into opposite sides, one of said cylinder and said piston being fixed against movement axially of the hydraulic cylinder-assembly axis and the other of said cylinder and said piston being axially movable relative to said one of said cylinder and said piston, a control valve assembly including a valve member and a valve housing axially movable relative to each other, said valve member being axially movable on an axis generally coinciding with the tilt axis, said valve housing being adapted to be connected to a source of pressurized hydraulic fluid and being hydraulically connected to said opposite sides of said cylinder, said valve member and said valve housing being movable relative to each other to control flow of hydraulic fluid from the source thereof to said cylinder, means connecting one of said valve housing and said valve member with said other of said cylinder and said piston for common movement, means connected to the other of said valve housing and said valve member for displacing said other of said valve member and said valve housing relative to said one of said valve housing and said valve member in response to operator activity, and means connecting said propulsion unit to said other one of said cylinder and said piston for effecting said steering movement of said propulsion unit in response to movement of said other of said cylinder and said piston incident to the application pressurized hydraulic fluid to said cylinder by said control valve assembly.

35. A marine propulsion device comrising a propulsion unit, mounting means adapted to be mounted on a boat and connected to said propulsion unit for affording tilting movement of said propulsion unit about a generally horizontal tilt axis and pivotal steering movement of said propulsion unit in opposite directions about a steering axis transverse to the tilt axis, a hydraulic cylinder-piston assembly including a cylinder and a piston mounted in said cylinder and dividing said cylinder into opposite sides, one of said cylinder and said piston being fixed against movement axially of the hydraulic cylinder-piston assembly axis and the other of said cylinder and said piston being axially movable relative to said one of said cylinder and said piston, a control valve assembly including a valve member and a valve housing, said valve housing being adapted to be connected to a source of pressurized hydraulic fluid and being hydraulically connected to said opposite sides of said cylinder, said valve member and said valve housing being rotatably movable relative to each other and being axially movable relative to each other along an axis generally coinciding with the tilt axis to control flow of hydraulic fluid from the source to said cylinder, means connecting one of said valve housing and said valve member with said other of said cylinder and said piston for common movement, means connected to the other of said valve housing and said valve member for axially displacing said other of said valve member and said valve housing relative to said one of said valve housing and said valve member in response to operator activity, and means connecting said propulsion unit to said other of said cylinder and said piston for effecting steering movement of said propulsion unit in response to movement of said other of said cylinder and said piston incident to the application of pressurized hydraulic fluid to said cylinder by said control valve assembly.

36. A marine propulsion device according to claim 35 wherein said valve member is axially movable on an axis generally coinciding with the tilt axis.

37. A marine propulsion device comprising a propulsion unit, mounting means adapted to be mounted on a boat and connected to said propulsion unit for affording pivotal steering movement of said propulsion unit in opposite directions about a steering axis, and power assist means adapted to operably connect an actuator to said propulsion unit for increasing the steering force applied to said propulsion unit by the actuator, said power assist means being wholly supported on said mounting means and including a hydraulic cylinder-piston assembly including a cylinder, a piston mounted in said cylinder for reciprocative movement therein, and an extendable and retractably piston rod connected to said piston, one of said cylinder and said piston being fixed against movement axially of said cylinder-piston assembly, and control means for selectively extending and retracting said piston rod relative to said cylinder, said control means having first and second members rotatably and axially movable relative to each other, one of said members being adapted to be connected to the actuator for axial movement relative to the other of said members in response to movement of the actuator, and said other member being connected to the other of said piston and said cylinder for common movement therewith and connected to said propulsion unit for effecting steering movement of said propulsion unit in response to movement of said other member.

38. A marine propulsion device comprising a propulsion unit, mounting means adapted to be mounted on a boat and connected to said propulsion unit for affording tilting movement of said propulsion unit about a generally horizontal tilt axis and pivotal steering movement of said propulsion unit in opposite directions about a steering axis transverse to the tilt axis, a fluid actuated cylinder-piston assembly having an axis and including a cylinder, and a piston mounted in said cylinder and dividing said cylinder into opposite sides, one of said cylinder and said piston being fixed against movement axially of the cylinder-piston assembly axis and the other of said cylinder and said piston being axially movable relative to said one of said cylinder and said piston, a control valve assembly including a valve member and a valve housing, said valve housing being adapted to be connected to a source of pressurized fluid and being fluidly connected to said opposite sides of said cylinder, said valve member and said valve housing being rotatably movable relative to each other and being axially movable relative to each other along an axis generally coinciding with the tilt axis to control flow of fluid from the source to said cylinder, means connecting one of said valve housing and said valve member with said other of said cylinder and said piston for common movement, means connected to the other of said valve housing and said valve member for axially displacing said other of said valve member and said valve housing relative to said one of said valve housing and said valve member in response to operator activity, and means connecting said propulsion unit to said other of said cylinder and said piston for effecting steering movement of said propulsion unit in response to movement of said other of said cylinder and said piston incident to the application of pressurized fluid to said cylinder by said control valve assembly.

39. A marine propulsion device according to claim 38 wherein said valve member is axially movable on an axis generally coinciding with the tilt axis.

40. A marine propulsion device comprising a propulsion unit, mounting means adapted to be mounted on a boat and connected to said propulsion unit for affording pivotal steering movement of said propulsion unit in opposite directions about a steering axis, and power assist means adapted to operably connect an actuator to said propulsion unit for increasing the steering force applied to said propulsion unit by the actuator, said power assist means being wholly supported on said mouting means and including a fluid actuated cylinder-piston assembly including a cylinder, a piston mounted in said cylinder for reciprocative movement therein, and an extendible and retractable piston rod connected to said piston, one of said cylinder and said piston being fixed against movement axially of said cylinder-piston assembly, and control means for selectively extending and retracting said piston rod relative to said cylinder, said control means having first and second members rotatably and axially movable relative to each other, one of said members being adapted to be connected to the actuator for axial movement relative to the other of said members in response to movement of the actuator, and the other of said members being connected to the other of said piston and said cylinder for common movement therewith and connected to said propulsion unit for effecting steering movement of said propulsion unit in response to movement of said other of said members.

* * * * *